US010844556B2

(12) United States Patent
Wehrenberg et al.

(10) Patent No.: US 10,844,556 B2
(45) Date of Patent: Nov. 24, 2020

(54) SCREED EXTENSION FOR A MAIN SCREED FRAME OF A PAVING MACHINE

(71) Applicant: Caterpillar Paving Products Inc., Brooklyn Park, MN (US)

(72) Inventors: Timothy L Wehrenberg, Maple Grove, MN (US); Ryan Schuette, Saint Michael, MN (US); John Eron Jorgensen, Andover, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 0 days.

(21) Appl. No.: 16/360,095

(22) Filed: Mar. 21, 2019

(65) Prior Publication Data

US 2020/0299908 A1 Sep. 24, 2020

(51) Int. Cl.

| | |
|---|---|
| ***E01C 19/00*** | (2006.01) |
| ***E01C 19/42*** | (2006.01) |
| ***E01C 19/48*** | (2006.01) |

(52) U.S. Cl.

CPC ..... *E01C 19/42* (2013.01); *E01C 19/4873* (2013.01); *E01C 2301/14* (2013.01)

(58) Field of Classification Search

CPC ... E01C 19/42; E01C 19/4873; E01C 2301/14
USPC ..... 404/84.05, 118
See application file for complete search history.

(56) References Cited

U.S. PATENT DOCUMENTS

| | | | | |
|---|---|---|---|---|
| 6,158,921 | A | 12/2000 | Holmes | |
| 6,273,636 | B1 * | 8/2001 | Johanpeter | E01C 19/4893 404/104 |
| 7,651,295 | B2 | 1/2010 | Eppes | |
| 7,909,534 | B1 * | 3/2011 | Comer | E01C 19/42 404/118 |
| 8,221,025 | B2 | 7/2012 | Buschmann et al. | |
| 8,353,642 | B2 | 1/2013 | Munz et al. | |
| 9,200,415 | B2 | 12/2015 | Graham et al. | |
| 9,212,457 | B2 | 12/2015 | Wagner et al. | |
| 9,222,227 | B2 | 12/2015 | Kopacz et al. | |
| 9,534,348 | B2 * | 1/2017 | Rio | E01C 19/22 |
| 10,358,779 | B2 * | 7/2019 | Comer | E01C 19/42 |
| 2010/0150651 | A1 * | 6/2010 | Buschmann | E01C 19/48 404/82 |

FOREIGN PATENT DOCUMENTS

| | | |
|---|---|---|
| CN | 206783230 | 12/2017 |

* cited by examiner

*Primary Examiner* — Raymond W Addie
(74) *Attorney, Agent, or Firm* — Jeff A. Greene

(57) ABSTRACT

A screed extension for a main screed frame of a paving machine includes an upper frame and a lower frame disposed below the upper frame. A height adjustment system is disposed between, and coupled to, the upper and lower frames. The height adjustment system is configured to moveably couple the lower frame to the upper frame. The height adjustment system includes an upper mounting plate affixed to the upper frame, and a lower mounting plate affixed to the lower frame. The height adjustment system also includes a first tube that is located between and coupled to the upper and lower mounting plates such that a first end of the first tube is configured to establish an interference fit with the upper mounting plate and a second end of the first tube is configured to establish an interference fit with the lower mounting plate.

18 Claims, 5 Drawing Sheets

SCREED EXTENSION FOR A MAIN SCREED FRAME OF A PAVING MACHINE

TECHNICAL FIELD

The present disclosure relates to a paving machine. More particularly, the present disclosure relates to a screed extension for a main screed frame of a paving machine.

BACKGROUND

A paving machine typically uses a screed to heat and/or compress paving materials, for example, asphalt, concrete, or another suitable aggregate of materials. A screed of a paving machine may be adjustable out to a pre-defined width, but often it is desirable to extend the width through the use of extendable screed extensions. The screed extensions may be mounted to the main screed body, and in some cases, these screed extensions may not be collinear with the main screed body. For example, each screed extension may be mounted in front of, or behind, the main screed body. Therefore, when the height of the main screed body is adjusted up or down, the extension may move differently than the main body because it has a different radius from a pivot point of the main screed body.

Many current systems use a 'four post' system for adjusting the height of an extendable screed. However, manually loosening each post, making the adjustment, and re-tightening each post is very time and labor intensive. Such an adjustment technique may be time consuming and, given the work environment, often hot, dirty, and difficult to work on. U.S. Pat. No. 9,222,227 discloses an apparatus for adjusting the height and angle of attack of the extendable screed relative to the main screed. Although the '227 patent provides a much-needed apparatus for automatically adjusting the height and angle of attack of the extendable screed relative to the main screed, manufacturers of screed assemblies are continuing to pursue further developments for achieving a reduced complexity in system design of a screed while also striving to improve a quality of paving operation with use of the paving system.

SUMMARY OF THE DISCLOSURE

In an aspect of the present disclosure, a screed extension is provided for a main screed frame of a paving machine. The screed extension includes an upper frame, a lower frame disposed below the upper frame, and a height adjustment system disposed between, and coupled to, the upper and lower frames. The height adjustment system is configured to moveably couple the lower frame to the upper frame. The height adjustment system includes a pair of upper mounting plates spaced apart from one another and affixed to the lower frame. Further, the height adjustment system also includes a pair of lower mounting plates located below the pair of upper mounting plates. The pair of lower mounting plates are disposed in a spaced apart manner from the pair of upper mounting plates and affixed to the lower frame. Furthermore, the height adjustment system also includes a pair of first tubes spaced apart from one another and coupled to corresponding pairs of the upper and lower mounting plates. A first end of the pair of first tubes are configured to establish an interference fit with the upper mounting plate and a second end of the pair of first tubes are configured to establish an interference fit with the lower mounting plate.

In another aspect of the present disclosure, a paving machine includes a main screed frame, and a pair of screed extensions that are disposed on opposite sides of the main screed frame. The pair of screed extensions are moveably coupled to the main screed frame. Each screed extension includes an upper frame, a lower frame disposed below the upper frame, and a height adjustment system disposed between, and coupled to, the upper and lower frames. The height adjustment system is configured to moveably couple the lower frame to the upper frame. The height adjustment system includes a pair of upper mounting plates spaced apart from one another and affixed to the lower frame. Further, the height adjustment system also includes a pair of lower mounting plates located below the pair of upper mounting plates. The pair of lower mounting plates are disposed in a spaced apart manner from the pair of upper mounting plates and affixed to the lower frame. Furthermore, the height adjustment system also includes a pair of first tubes spaced apart from one another and coupled to corresponding pairs of the upper and lower mounting plates. A first end of the pair of first tubes are configured to establish an interference fit with the upper mounting plate and a second end of the pair of first tubes are configured to establish an interference fit with the lower mounting plate.

Other features and aspects of this disclosure will be apparent from the following description and the accompanying drawings.

DETAILED DESCRIPTION

Figure 1:
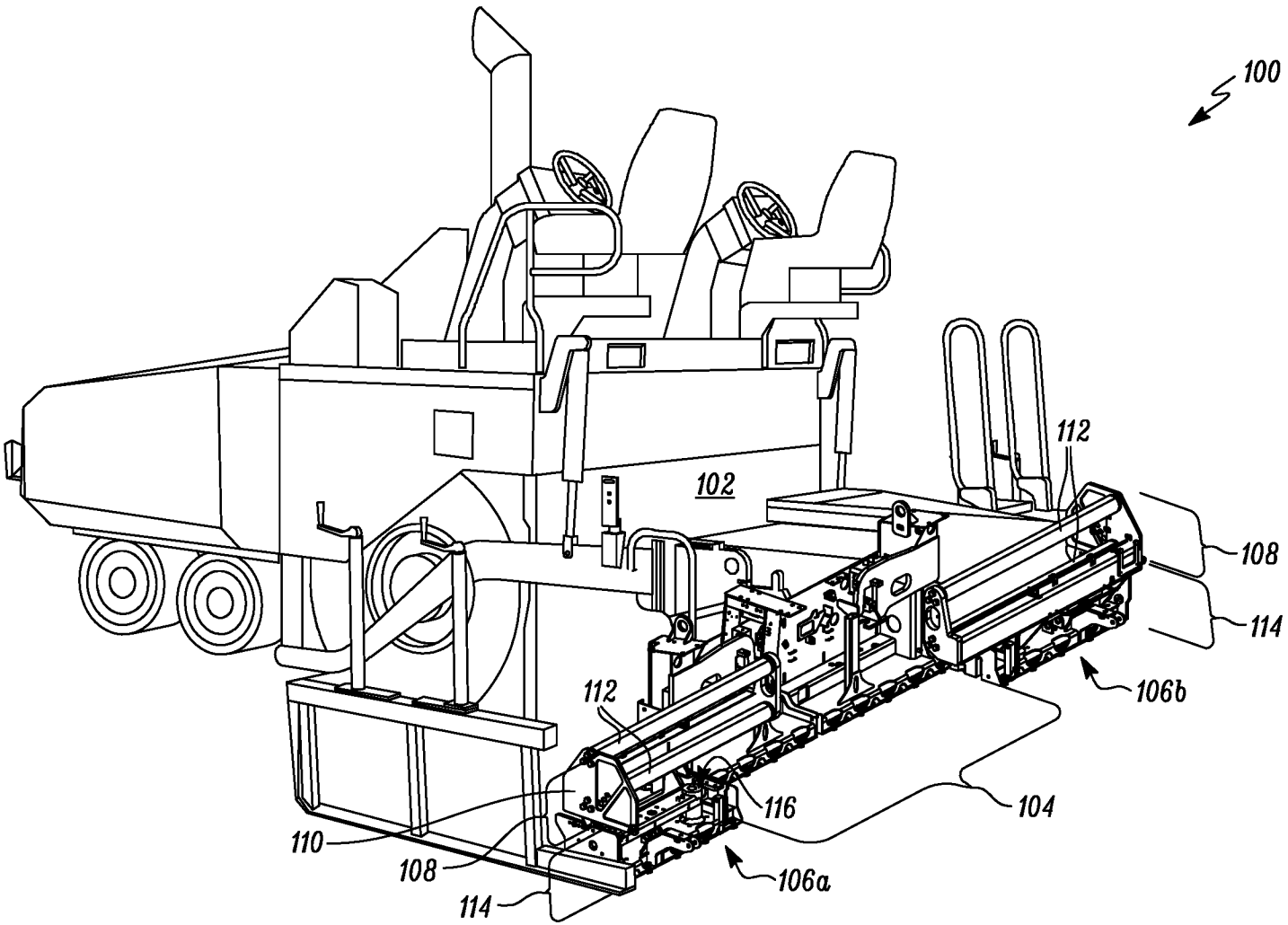
FIG. 1 is a rear perspective view of a paving machine having a main screed frame and a pair of screed extensions, according to an embodiment of the present disclosure.

Wherever possible, the same reference numbers will be used throughout the drawings to refer to the same or the like parts. Referring to FIG. 1, a paving machine 100 is illustrated according to an embodiment of the present disclosure. The paving machine 100 disclosed herein may be embodied for use as, for example, an asphalt paving machine, a concrete paving machine, or a paving machine that can be used to lay other suitable aggregates of base materials known to persons skilled in the art. For sake of brevity, the paving machine 100 will hereinafter be referred to as 'the paver' and denoted with identical numeral '100'.

As shown in FIG. 1, the paver 100 includes a frame 102. The frame 102 is adapted to support various components of the paver 100 thereon. The paver 100 includes a main screed frame 104 that is moveably mounted on the frame 102. The paver 100 also includes a pair of screed extensions 106*a*, 106*b* that are disposed on opposite sides of the main screed frame 104. Each screed extension 106*a*, 106*b* is moveably coupled to the main screed frame 104. Each screed extension 106*a*, 106*b* has an upper frame 108.

Figure 2:
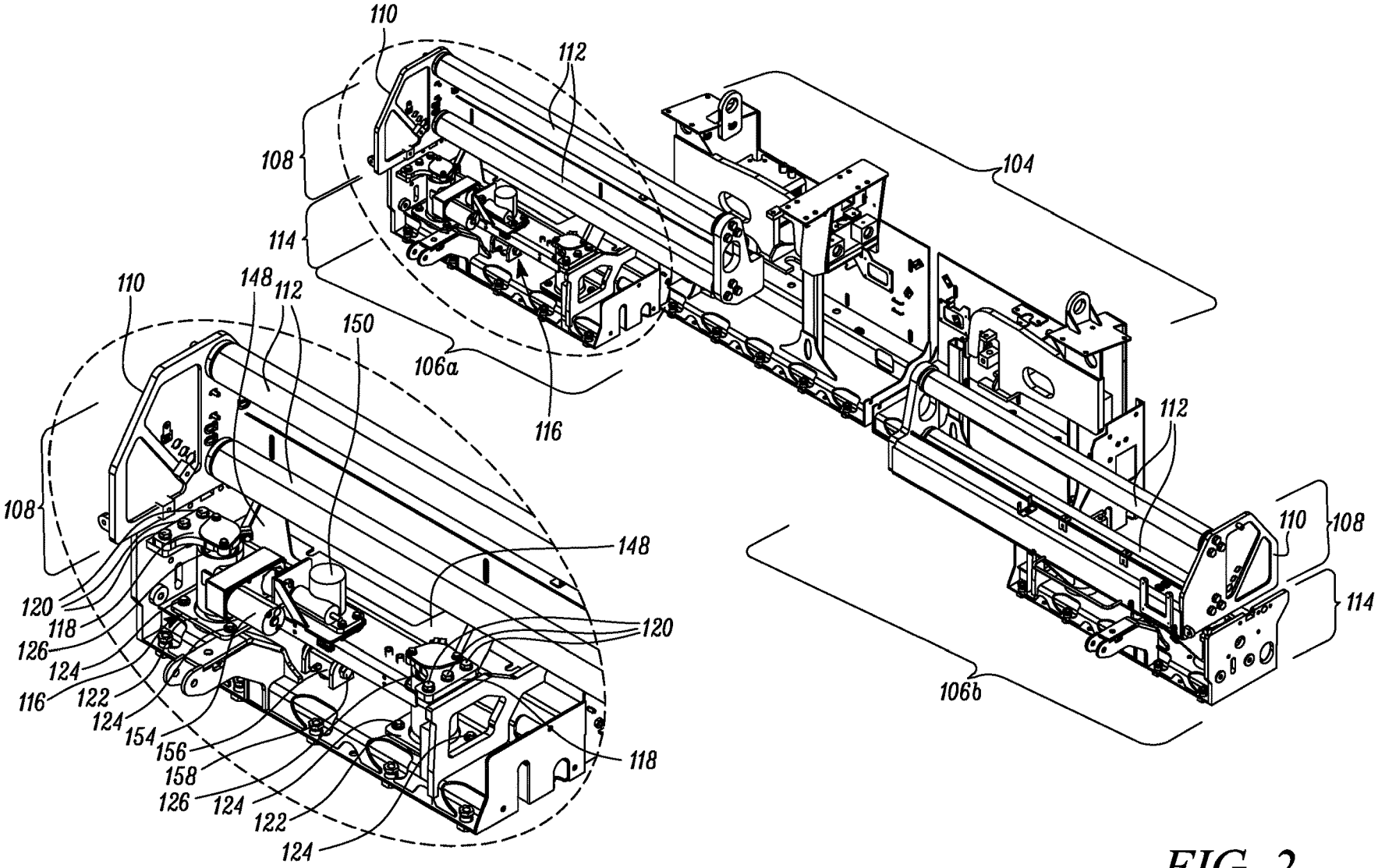
FIG. 2 is a top perspective view of the main screed frame and the pair of screed extensions showing a zoomed-in view of a height adjustment system, according to an embodiment of the present disclosure.

Referring to FIG. 2, the upper frame 108 from each screed extension 106*a*, 106*b* has an end plate 110, and a pair of extender tubes 112 extending between the end plate 110 and the main screed frame 104 for moveably coupling the corresponding screed extension 106*a*, 106*b* to the main screed frame 104. Wherever the context of the present disclosure so applies, the first and second screed extensions 106*a*, 106*b* may be individually referred to as "the screed extension/s" or "each screed extension" and simply denoted using the numeral 106.

Further, as shown in FIG. 2, each screed extension 106 includes a lower frame 114 disposed below the upper frame 108. Each screed extension 106 also includes a height adjustment system 116 disposed between, and coupled to, the upper and lower frames 108, 114 of the corresponding screed extension 106. The height adjustment system 116 is configured to moveably couple the lower frame 114 to the upper frame 108. It may be noted that the screed extension 106 of the present disclosure may also include other components that are unrelated to an operation of the height adjustment system 116. However, such components have been omitted from the accompanying drawings for sake of simplicity in aiding the reader to understand the present disclosure.

Figure 3:
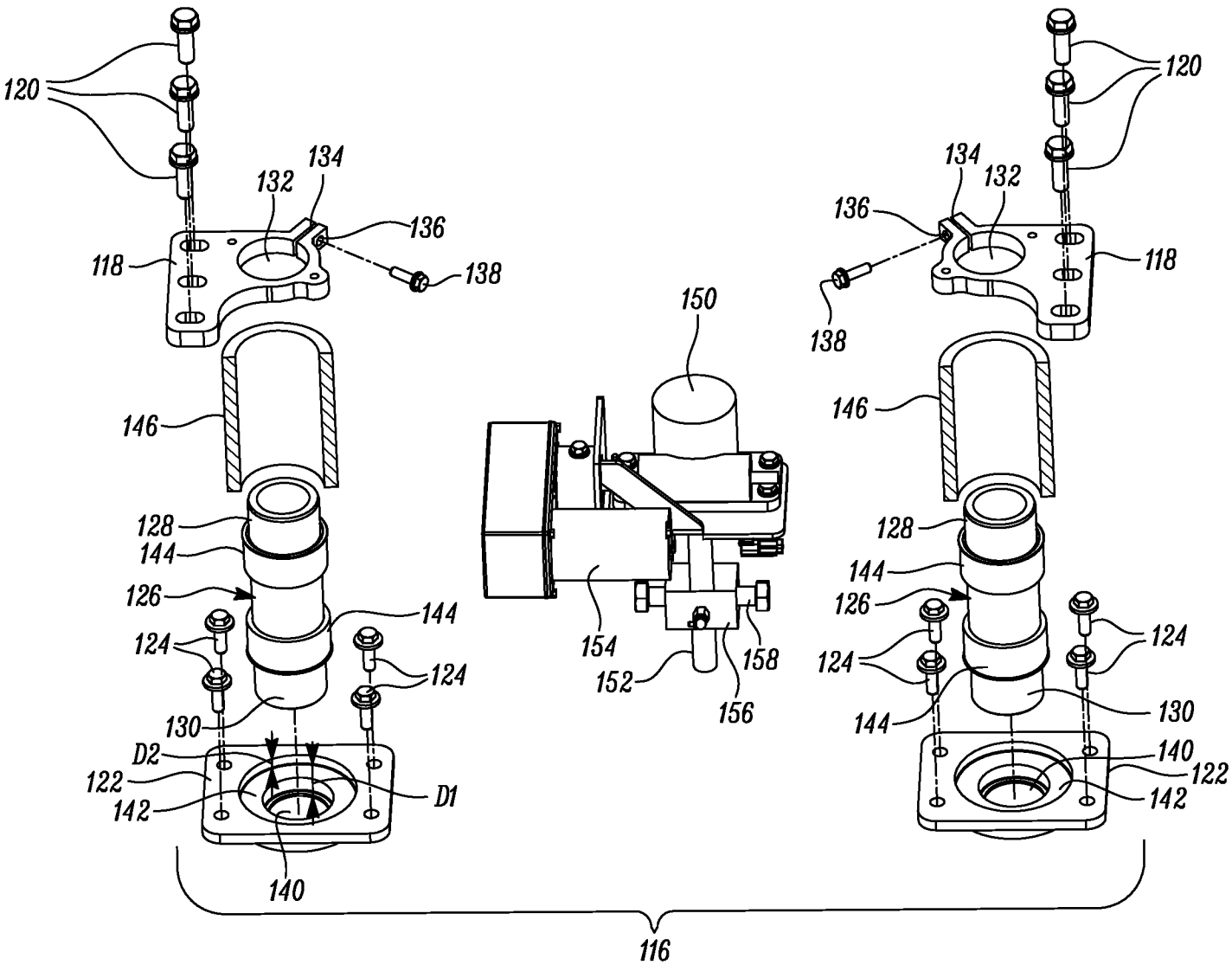
FIG. 3 is an exploded top perspective view of the height adjustment system associated with one of the screed extensions, according to an embodiment of the present disclosure.

Referring to FIGS. 2 and 3, the height adjustment system 116 includes a pair of upper mounting plates 118 spaced apart from one another and affixed to the lower frame 114, for example, using fasteners 120 as shown. Further, the height adjustment system 116 also includes a pair of lower mounting plates 122 located below the pair of upper mounting plates 118. The pair of lower mounting plates 122 are disposed in a spaced apart manner from the pair of upper mounting plates 118 and affixed to the lower frame 114, for example, using fasteners 124 as shown. Furthermore, the height adjustment system 116 also includes a pair of first tubes 126 spaced apart from one another and coupled to corresponding pairs of the upper and lower mounting plates 118, 122. A first end 128 of the pair of first tubes 126 are configured to establish an interference fit with the upper mounting plate 118 and a second end 130 of the pair of first tubes 126 are configured to establish an interference fit with the lower mounting plate 122.

In an embodiment as shown best in the view of FIG. 3, each upper mounting plate 118 has a cut-out 132 defined thereon for receiving the first end 128 of a corresponding first tube 126 therein. Further, each upper mounting plate 118 also has a slot 134 extending radially outward from the cut-out 132 to an outer circumference of the upper mounting plate 118. Furthermore, each upper mounting plate 118 also includes a pair of threaded receptacles 136 that are located in transverse relation to the slot 134. The pair of threaded receptacles 136 are in alignment with one another for axially receiving a fastener 138 therein. Upon positioning the first end 128 of the first tube 126 in the cut-out 132 of the upper mounting plate and engaging the fastener 138 with the pair of threaded receptacles 136, the two adjacently located flared portions of the top mounting plate diminish the slot 134 to manifest a compressive force on the first end 128 of the first tube thereby establishing the interference fit between the upper mounting plate 118 and the first end 128 of the first tube 126.

In an embodiment as best shown in the view of FIG. 3, each lower mounting plate 122 has a first receptacle 140 defined thereon. The first receptacle 140 is configured to have a diameter slightly smaller than the second end 130 of a corresponding first tube 126 requiring the second end 130 to be press fit into the first receptacle 140 to establish the interference fit between the second end 130 of the corresponding first tube 126 and the first receptacle 140 of the lower mounting plate 122. Other commonly known techniques to create the interference fit between the second end 130 of the first tube 126 and the lower mounting plate 122 are equally applicable. Each lower mounting plate 122 also has a second receptacle 142 that is disposed around the first receptacle 140. The second receptacle 142 has a depth 'D2' less than a depth 'D1' of the first receptacle 140 for facilitating axial movement of the second tube 146 therein.

Figure 5:
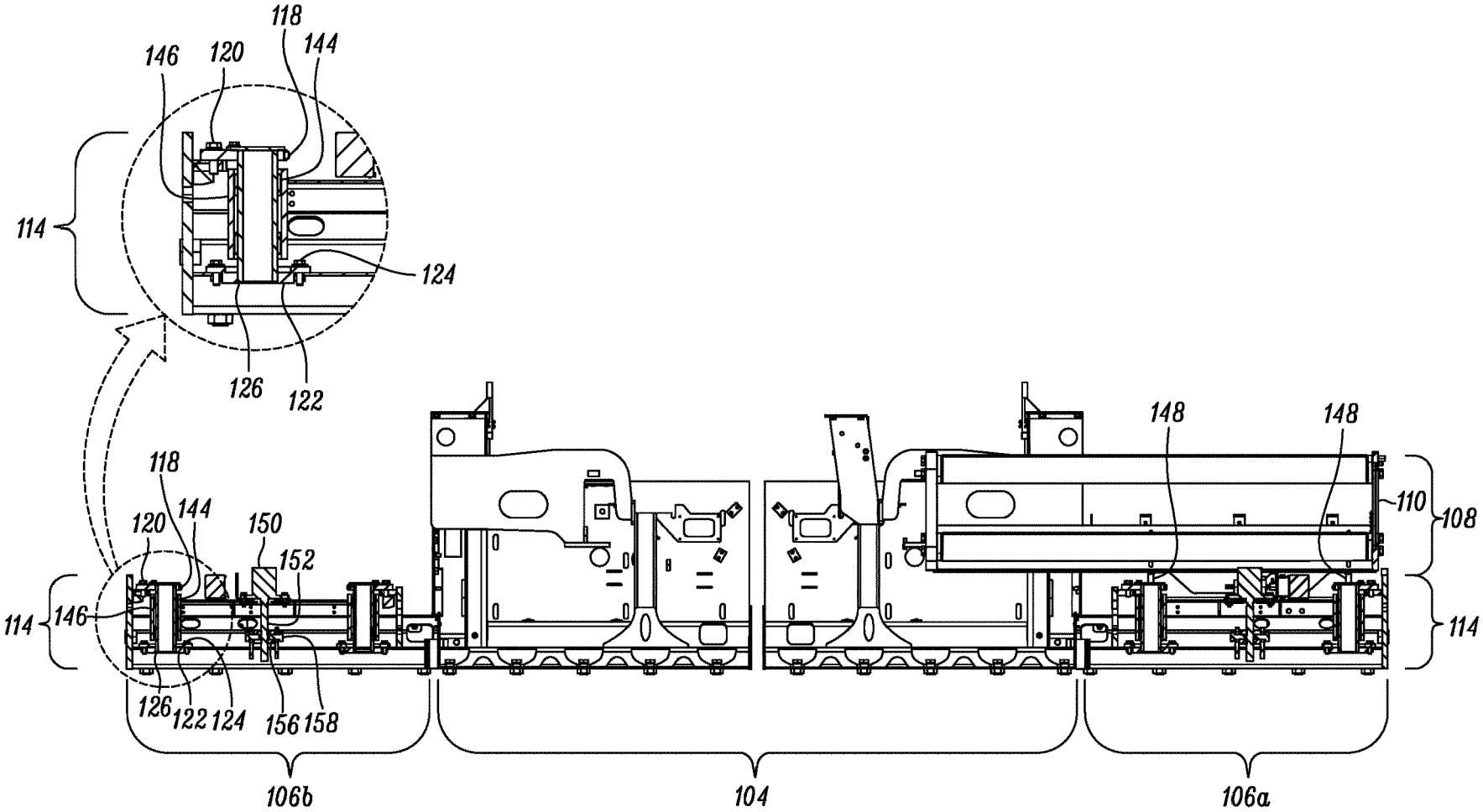
FIG. 5 is a rear sectional view of the main screed frame and the pair of screed extensions sectioned along a common mid-plane shared mutually by the pair of screed extensions as shown in the view of FIG. 4, according to an embodiment of the present disclosure.

In an embodiment as best shown in the view of FIG. 3, the height adjustment system 116 further includes a pair of bushings 144 that are disposed on an outer circumference of each first tube 126. Further, as shown in FIG. 5, the height adjustment system 116 also includes a pair of second tubes 146. Each second tube 146 is disposed about the pair of bushings 144 on the outer circumference of a corresponding first tube 126 and coupled to the upper frame 108 via an arm 148. In embodiments herein, the bushings 144 may be configured to reduce the play between the second tube 146 and a corresponding first tube 126 as these components i.e., the first and second tubes 126, 146 may carry a considerable side load when the paver 100 is in operation. Further, in embodiments herein, although two bushings 144 are associated with the outer circumference of each first tube 126, it may be noted that a number of bushings 144 is non-limiting of this disclosure. In other embodiments, fewer or more bushings 144 may be used in lieu of the pair of bushings 144 disclosed herein.

Further, in an embodiment as shown in FIGS. 2 to 5, the height adjustment system 116 further includes a height adjusting actuator 150 that is located between the spaced-apart pair of first tubes 126. The height adjusting actuator 150 is coupled to each of the upper and lower frames 108, 114 for operably moving the lower frame 114 with respect to the upper frame 108. In an exemplary embodiment as shown best in the view of FIGS. 2 and 3, the height adjusting actuator 150 may include a rotatable threaded drive rod 152 that may be operated by, for example, an electric motor 154 to co-operatively pull, or push, a threaded adjustment block 156 that is coupled to the drive rod 152 and the lower frame 114 using a cross-pin member 158 for raising or lowering the lower frame 114 in relation to the upper frame 108. Based on an input provided via an operator-controlled system (not shown), the electric motor 154 may be suitably commanded to rotate the drive rod 152 clockwise or counter-clockwise for raising or lowering the lower frame 114 in relation to the upper frame 108 so that a height of the lower frame 114 may be adjusted in relation to paving material during operation of the paver 100.

Figure 4:
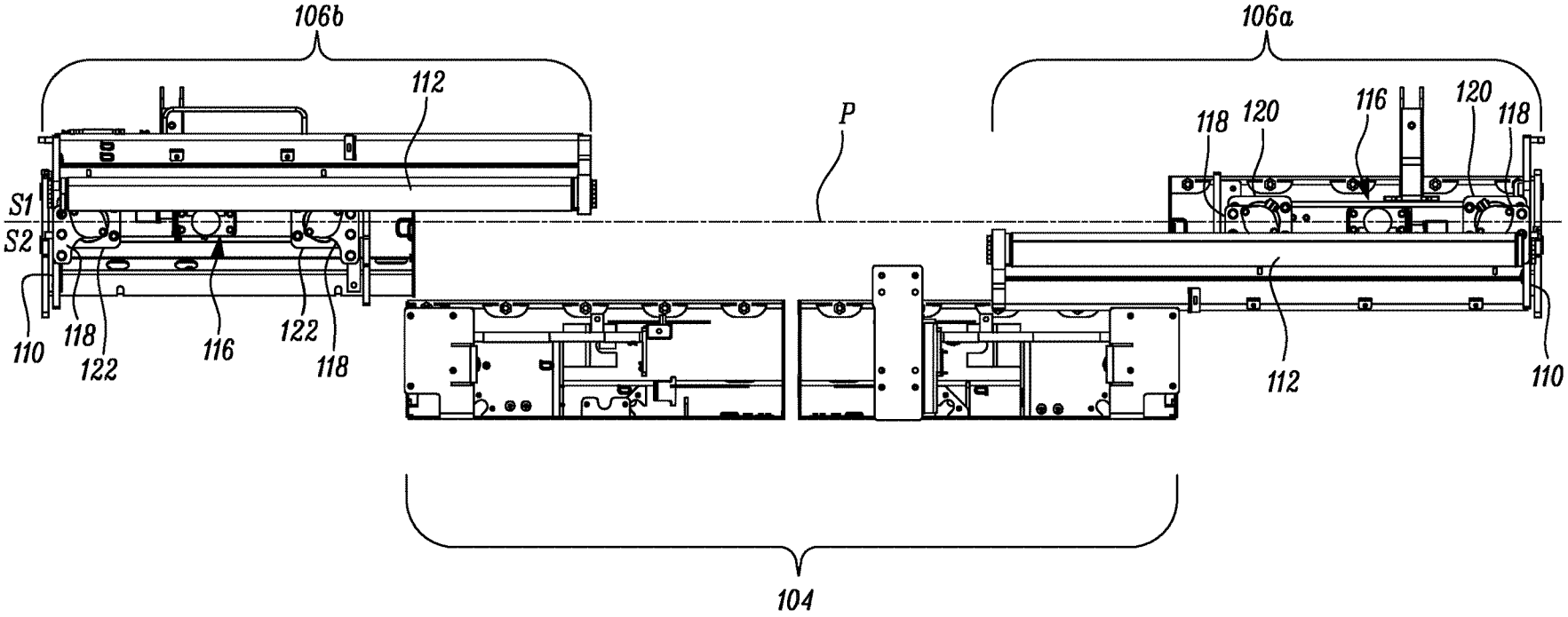
FIG. 4 is a top view of the main screed frame and the pair of screed extensions, according to an embodiment of the present disclosure.

In an embodiment as shown best in the view of FIG. 4, the pair of first tubes 126 from each screed extension 106 is disposed on a common mid-plane 'P' that is shared mutually by the pair of screed extensions 106*a*, 106*b*. For sake of clarity, wherever the context of the present disclosure so applies, the pair of screed extensions 106*a*, 106*b* will be distinctly referred to as "the first screed extension" and "the second screed extension" respectively and denoted using corresponding reference numerals '106*a*' and '106*b*' respectively. Further, the pair of extender tubes 112 from a first one of the screed extensions 106 is disposed on a first side 'S1' of the common mid-plane P and the pair of extender tubes 112 from a second one of the screed extensions 106 is disposed on a second side 'S2' of the common mid-plane P. For instance, as shown in the view of FIG. 4, the pair of extender tubes 112 from the first screed extension 106*a* is disposed on the first side S1 of the common mid-plane P and the pair of extender tubes 112 from the second screed extension 106*b* is disposed on the second side S2 of the common mid-plane P. Further, for axially supporting movement of the pair of extender tubes 112 of respective ones of the first and second screed extensions with respect to the main screed frame, profiles of the end plates 110 from respective ones of the first and second screed extensions are mirrored i.e., the profiles of the end plates 110 from respective ones of the first and second screed extensions are symmetric about the common mid-plane P as shown best in the view of FIG. 2.

INDUSTRIAL APPLICABILITY

The present disclosure has applicability for use in rendering a screed extension with improved integrity for withstanding lateral forces that may be encountered by the screed extension during operation of a paving machine.

With use of embodiments disclosed herein, the first and second ends 128, 130 of each first tube 126 is configured to establish interference fits with the upper and lower mounting plates 118, 122 respectively. These interference fits help minimize any play between the first tubes 126 and the upper and lower mounting plates 118, 122. Also, these interference fits may improve an integrity of the height adjustment system 116. With improved integrity, the first tubes 126 and the upper and mounting plates used to form the height adjustment system 116 of the present disclosure can support movement of the lower frame 114 relative to the upper frame 108 when the pair of second tubes 146 are moved in relation to the pair of first tubes 126, i.e., vis-à-vis the bushings 144 supporting axial movement alone. As such, the bushings 144 are configured such that they allow movement of an associated second tube 146 only along an axis of a corresponding first tube 126, thereby additionally improving the integrity of the height adjustment system 116 and rendering the height adjustment system 116 capable of withstanding lateral forces that the first and second screed extensions may encounter during operation of the paver 100.

Further, as disclosed in an embodiment herein, the pair of extender tubes 112 from the first screed extension 106*a* is disposed on the first side S1 of the common mid-plane P and the pair of extender tubes 112 from the second screed extension 106*b* is disposed on the second side S2 of the common mid-plane P of the pair of screed extensions. In addition, the profiles of the end plates 110 of the first and second screed extensions 106*a*, 106*b* mirror each other. Stated differently, the profiles of the end plates 110 of the first and second screed extensions 106*a*, 106*b* are symmetric about the mid-plane P. Upon assembly with the main screed frame 104, such a configuration of the first and second screed extensions 106*a*, 106*b* allows for the lateral forces acting on the pair of screed extensions 106*a*, 106*b* to be equal and opposite in nature thereby further minimizing the net lateral force on each of the first and second screed extensions 106*a*, 106*b* and/or the main screed frame 104. With minimized lateral forces on the first and second screed extensions 106*a*, 106*b* and/or the main screed frame 104, consistency in the paving operation from each of the main screed frame 104 and the first and second screed extensions 106*a*, 106*b* may be achieved thus leading to an improvement in the quality of a paved mat using the paver 100 of the present disclosure as compared to that achieved with use of traditionally designed paving systems.

While aspects of the present disclosure have been particularly shown and described with reference to the embodiments above, it will be understood by those skilled in the art that various additional embodiments may be contemplated by the modification of the disclosed paver 100, the screed extension 106, or the height adjustment system 116 without departing from the spirit and scope of the disclosure. Such embodiments should be understood to fall within the scope of the present disclosure as determined based upon the claims and any equivalents thereof.

What is claimed is:

1. A screed extension for a main screed frame of a paving machine, the screed extension comprising:
- an upper frame;
- a lower frame disposed below the upper frame; and
- a height adjustment system disposed between, and coupled to, the upper and lower frames, the height adjustment system configured to moveably couple the lower frame to the upper frame, the height adjustment system comprising:
  - a pair of upper mounting plates spaced apart from one another and affixed to the lower frame;
  - a pair of lower mounting plates located below the pair of upper mounting plates, wherein the pair of lower mounting plates are disposed in a spaced apart manner from the pair of upper mounting plates and affixed to the lower frame; and
  - a pair of first tubes spaced apart from one another and coupled to corresponding pairs of the upper and lower mounting plates, wherein a first end of the pair of first tubes are configured to establish an interference fit with the upper mounting plate and a second end of the pair of first tubes are configured to establish an interference fit with the lower mounting plate.

2. The screed extension of claim 1, wherein the height adjustment system further comprises a pair of bushings disposed on an outer circumference of each first tube.

3. The screed extension of claim 2, wherein the height adjustment system further comprises a pair of second tubes, each second tube disposed about the pair of bushings on the outer circumference of a corresponding first tube and coupled to the upper frame via a pair of arms.

4. The screed extension of claim 3, wherein each lower mounting plate has:
- a first receptacle defined thereon for receiving the second end of a corresponding first tube therein and for establishing the interference fit with the second end of the corresponding first tube; and
- a second receptacle disposed around the first receptacle, the second receptacle having a depth less than a depth of the first receptacle for facilitating movement of the second tube therein.

5. The screed extension of claim 1, wherein each upper mounting plate has:
- a cut-out defined thereon for receiving the first end of a corresponding first tube therein; and
- a slot extending radially outward from the cut-out to an outer circumference of the upper mounting plate.

6. The screed extension of claim 5, wherein each upper mounting plate further comprises a pair of threaded receptacles transversely located to the slot, the pair of threaded receptacles in alignment with one another for receiving a fastener axially therein and establishing the interference fit with the first end of the corresponding first tube.

7. The screed extension of claim 1, wherein the height adjustment system further comprises:

a height adjusting actuator located between the spaced-apart pair of first tubes and coupled to each of the upper and lower frames for operably moving the lower frame with respect to the upper frame.

8. A paving machine comprising:

a main screed frame;

a pair of screed extensions disposed on opposite sides of the main screed frame and moveably coupled to the main screed frame, each screed extension comprising:

an upper frame;

a lower frame disposed below the upper frame; and a height adjustment system disposed between, and coupled to, the upper and lower frames, the height adjustment system configured to moveably couple the lower frame to the upper frame, the height adjustment system comprising:

a pair of upper mounting plates spaced apart from one another and affixed to the lower frame;

a pair of lower mounting plates located below the pair of upper mounting plates, wherein the pair of lower mounting plates are disposed in a spaced apart manner from the pair of upper mounting plates and affixed to the lower frame; and a pair of first tubes spaced apart from one another and coupled to corresponding pairs of the upper and lower mounting plates, wherein a first end of the pair of first tubes are configured to establish an interference fit with the upper mounting plate and a second end of the pair of first tubes are configured to establish an interference fit with the lower mounting plate.

9. The paving machine of claim 8, wherein the height adjustment system further comprises a pair of bushings disposed on an outer circumference of each first tube.

10. The paving machine of claim 9, wherein the height adjustment system further comprises a pair of second tubes, each second tube disposed about the pair of bushings on the outer circumference of a corresponding first tube and coupled to the upper frame via a pair of arms.

11. The paving machine of claim 10, wherein each lower mounting plate has:

a first receptacle defined thereon for receiving the second end of a corresponding first tube therein and for establishing the interference fit with the second end of the corresponding first tube; and a second receptacle disposed around the first receptacle, the second receptacle having a depth less than a depth of the first receptacle for facilitating movement of the second tube therein.

12. The paving machine of claim 9, wherein each upper mounting plate has:

a cut-out defined thereon for receiving the first end of a corresponding first tube therein; and a slot extending radially outward from the cut-out to an outer circumference of the upper mounting plate.

13. The paving machine of claim 12, wherein each upper mounting plate further comprises a pair of threaded receptacles transversely located to the slot, the pair of threaded receptacles in alignment with one another for receiving a fastener axially therein and establishing the interference fit with the first end of the corresponding first tube.

14. The paving machine of claim 9, wherein the height adjustment system further comprises:

a height adjusting actuator located between the spaced-apart pair of first tubes and coupled to each of the upper and lower frames for operably moving the lower frame with respect to the upper frame.

15. The paving machine of claim 9, wherein the pair of first tubes from each screed extension is disposed on a common mid-plane shared mutually by the pair of screed extensions.

16. The paving machine of claim 15, wherein the upper frame from each screed extension further comprises:

an end plate; and a pair of extender tubes extending between the end plate and the main screed frame.

17. The paving machine of claim 16, wherein the pair of extender tubes from a first one of the screed extensions is disposed on a first side of the common mid-plane and the pair of extender tubes from a second one of the screed extensions is disposed on a second side of the common mid-plane.

18. The paving machine of claim 17, wherein a profile of the end plate on the first one of the screed extensions mirrors a profile of the end plate on the second one of the screed extensions, when both profiles are viewed along the common mid-plane.

* * * * *